United States Patent [19]

Watson

[11] Patent Number: 4,575,092

[45] Date of Patent: Mar. 11, 1986

[54] BALL DISPENSER

[76] Inventor: Gavin L. Watson, Wyndcliffe, Shooters Way La., Berkhamsted, Hertfordshire, England

[21] Appl. No.: 637,736

[22] Filed: Aug. 6, 1984

[30] Foreign Application Priority Data

Aug. 5, 1983 [GB] United Kingdom ..... 8321142

[51] Int. Cl.[4] ..... A63B 57/00

[52] U.S. Cl. ..... 273/201; 273/32 D

[58] Field of Search ..... 273/26 D, 29 A, 201; 221/194

[56] References Cited

U.S. PATENT DOCUMENTS

| | | | |
|---|---|---|---|
| 1,868,261 | 7/1932 | Spencer | 273/201 |
| 1,937,180 | 11/1933 | Young | 273/201 |
| 3,281,013 | 10/1966 | Motard | 273/201 |
| 3,458,204 | 7/1969 | Wilson | 273/201 |
| 3,599,983 | 8/1971 | Melton | 273/201 |

FOREIGN PATENT DOCUMENTS

| | | | |
|---|---|---|---|
| 1429211 | 1/1966 | France | 273/201 |
| 374052 | 5/1932 | United Kingdom | 273/201 |
| 1073545 | 6/1967 | United Kingdom | 273/201 |
| 1125353 | 8/1968 | United Kingdom | 273/201 |
| 1180638 | 2/1970 | United Kingdom | 273/201 |
| 1444066 | 7/1976 | United Kingdom | 273/201 |

*Primary Examiner*—Richard C. Pinkham
*Assistant Examiner*—T. Brown
*Attorney, Agent, or Firm*—Young & Thompson

[57] ABSTRACT

Apparatus for dispensing balls, for example, golf or tennis balls, comprising a magazine (10), which can be mounted to extend downwardly to receive a plurality of balls (14,14') to be dispensed from the lower end thereof, a ball-dispensing structure (16) having a first condition in which the lowermost ball (14) is restrained in the magazine (10) and a second condition in which the lowermost ball (14) is released and another ball (14') is restrained in the magazine (10), the ball-dispensing structure (16) thereby being operable by change between its two conditions to dispense at least the lowermost ball (14) while restraining at least one other ball (14') in the magazine (10).

8 Claims, 6 Drawing Figures

10
42
28
45
17a
32
30
II
16
17b
40
44
48
50
26
14'
14
38
46
36
34
24
22
20
18
12
A
52
53
14''

BALL DISPENSER

This invention relates to apparatus for dispensing balls, for example golf or tennis balls. The ball-dispensing apparatus according to the invention is particularly suitable for use in practising such ball games as golf or tennis. In order to simplify this disclosure, the invention is described below in conjunction with use of a number of embodiments of the apparatus for practising golf driving, putting and other operations though it will be seen that other games can employ the apparatus of the invention.

Apparatus for collecting golf balls is known and such apparatus usually consists of a tubular magazine arranged at one end to pass over balls, e.g. on the ground, and then hold them, so that the tubular magazine can be used to dispense the balls from the other end, for further practice purposes. Various forms of apparatus of this kind are shown, for instance, in FR-A-1429211, GB-A-1125353, and GB-A-1444066. The latter also discloses a springloaded pawl having a tooth which normally projects into the tube and can be pivoted away from the open end of the tube to allow the balls to be dispensed. Apparatus for holding a supply of balls and allowing them to be dispensed on actuating a movable part of the apparatus, is also known. A pneumatically-operated mechanism including a vertically-reciprocable tee member is shown in GB-A-1180638. Other forms of ball releasing mechanism, involving moving parts operated by contact with a golf club, for example, are disclosed in GB-A-374052, US-A-3458204 and 3599983. The present invention meets the need for a simple and therefore inexpensive and reliable form of apparatus, which can be used as required to dispense balls one at a time into a predetermined position raised above the ground, e.g. for contact with a wood or other driver club, or into an arbitrary position on the ground, e.g. for contact with a putter or other golf club, as desired. The apparatus of the invention also can be arranged to dispense golf balls so that the next available is made ready for dispensing, on one movement of a ball-releasing member included in the apparatus, but it is not dispensed until such member undergoes a second movement. e.g. by returning to its first position.

An apparatus according to the invention comprises a magazine for receiving a plurality of balls and which can be mounted so as to extend downwardly to permit the balls to be dispensed from the lower end thereof, and ball-releasing means, characterised by having a first condition in which the lowermost ball is restrained in the magazine and a second condition in which the lowermost ball is released from the magazine and another ball is restrained in the magazine, the ball-releasing means thereby being operable by change between the two conditions to dispense at least the lowermost ball whilst restraining at least one other ball in the magazine.

The ball-releasing means may be movable relative to the magazine between a first position, in which the lowermost ball is prevented from movement out of the magazine, and a second position in which such lowermost ball is released and another ball is held.

Conveniently, the ball-releasing means is a pawl mechanism mounted to pivot relative to a tube forming a guideway of the magazine and has first and second portions for abutment respectively making contact with the lowermost and other balls.

The pawl mechanism is conveniently operated by a foot or hand lever.

Advantageously, a resilient biassed member is arranged so as to bias the ball-releasing means towards one of its positions. When the bias is towards the first position, movement of the pawl mechanism against the bias to its second position will release the ball or balls whose movement is not blocked by the blocking member when in its second position. Return of the blocking member under influence of the resilient bias will allow the balls to move along the guideway until movement of the leading ball is blocked by the pawl mechanism now returned to its first position. If the bias is in the opposite direction, movement of the pawl mechanism from its second to its first position against the bias will allow the balls to advance along the guideway until the leading ball is blocked by the pawl mechanism in its first position. Return movement of the pawl mechanism will result in release of the ball or balls downstream of the ball whose movement is blocked by the pawl mechanism in its second position. In each case, movement of the pawl mechanism from one of its positions to the other against the bias and return under influence of the bias will result in a predetermined number of balls, usually one, being dispensed from the apparatus.

The guideway is conveniently constituted by a tube which is advantageously removable for charging with balls from a base portion of the apparatus including the ball-dispensing means. The tube may have at its end which does not engage the base portion at least one deformable member (for example a resilient lip) which is directed inwardly of the tube and deforms outwardly to allow entry of a ball into the tube when the tube is placed over a ball lying on the ground. The member or members subsequently revert to their usual shape to retain the balls in the tube.

A base portion of the equipment, as mentioned above, may include a chute for directing balls dispensed from the apparatus to a desired position and, additionally or alternatively, include means (for example one or more spikes) for engaging the ground.

The apparatus of the invention thus achieves its stated objects and allows a golfer, for instance, to practice any desired strokes with any desired clubs and provides the golfer with an easily portable, inexpensive and reliable apparatus for picking up and storing golf balls, dispensing them as required and allowing driving, putting and other strokes to be practised.

Various embodiments of the invention are described below, by way of example only, in conjunction with the accompanying drawings, in which.

Figures 1, 2:
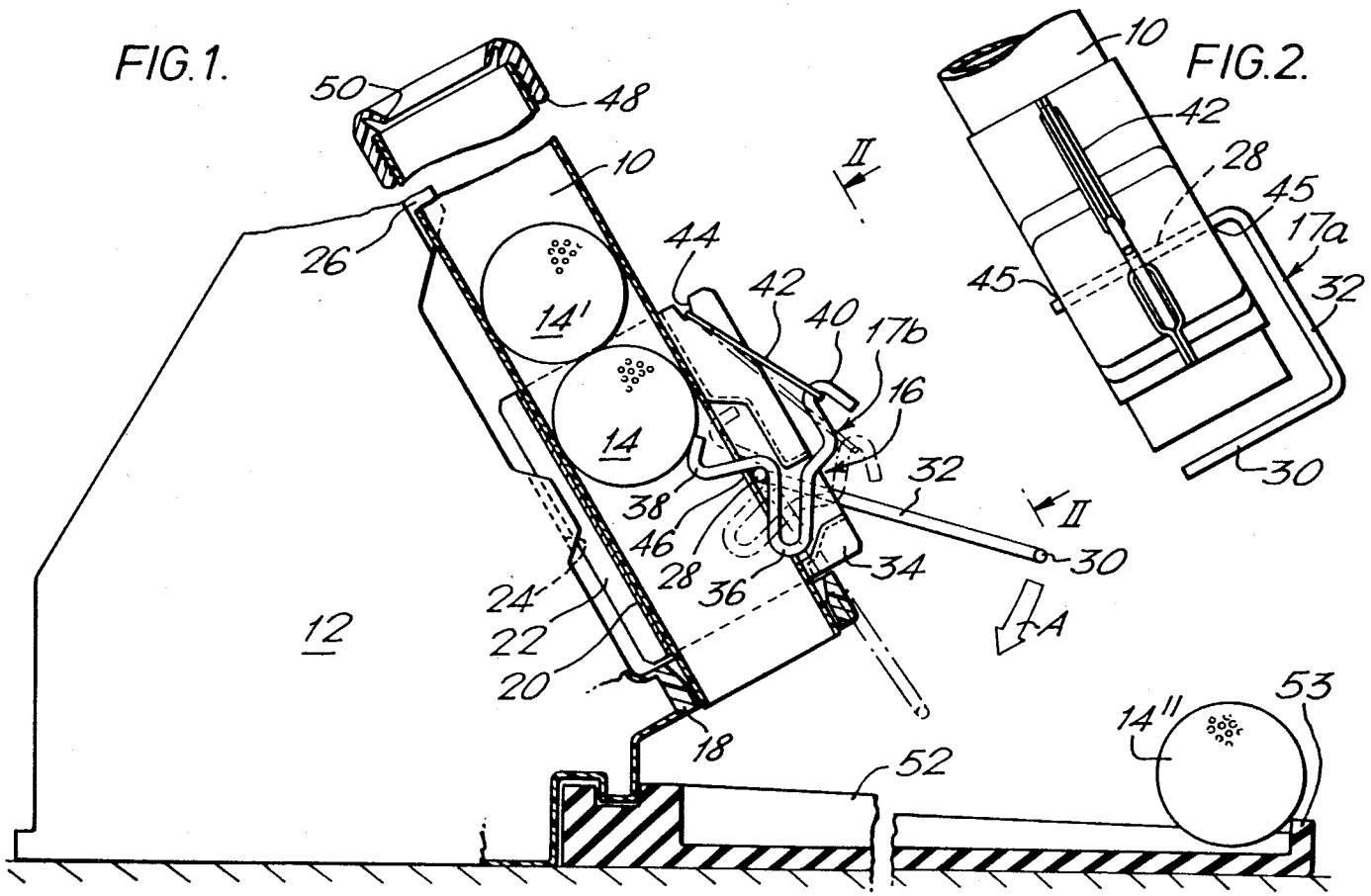
FIG. 1 shows a vertical sectional view of a first form of dispenser for golf balls, including portions of its ball storage tube or magazine.
FIG. 2 shows a detailed view of the dispenser of FIG. 1, in the direction of the arrows II—II.

The ball dispenser apparatus shown in FIGS. 1 and 2 comprises a ball-retrieving, storage and dispensing magazine in the form of a tube 10. This tube 10 is supported at an angle of about 60° to the horizontal by a stand 12. The tube 10 serves to receive and contain a stack of golf balls, the leading two of which are shown at 14 and 14' respectively. The tube 10 has a ball releasing pawl mechanism 16 at its lower end.

The stand 12 has an integral collar 18 which receives and supports the lower end of the tube 10 by abutment against a sleeve 20 fitted around the exterior of the tube 10. The sleeve 20 has at least one longitudinal rib 22, which is received in a corresponding slot 24 in the stand 12, when the tube 10 and the stand 12 are assembled. By this arrangement, the tube 10 is located against rotational movement relative to the stand 12. A cradle portion 26 is provided adjacent the upper end of the stand 12 and this also supports the tube 10.

The ball-releasing pawl mechanism 16 is formed from two pieces **17*a*, 17*b* of suitably-bent metal rod, which are joined together to constitute the mechanism 16. The first piece 17*a* is generally U-shaped and is best seen in FIG. 2 of the drawings. This member 17*a* includes a first limb 28, which serves in use as a spindle about which the pawl mechanism 16 pivots, a second limb 30 parallel to and spaced from the limb 28 and forming an operating handle for the pawl mechanism 16. The side limbs 28 and 30 of the piece 17*a* are joined by an intermediate portion 32, which acts as a lever arm for operating the pawl mechanism 16. The spindle or limb 28 is mounted for rotation relative to the sleeve 20 in apertures 45 provided in a projecting portion 34 of the sleeve 20. The second piece 17*b* of the pawl mechanism 16 is rigidly attached to the spindle limb 28, e.g. by welding or brazing. As shown best in FIG. 1, the wire or rod piece 17*b* forms two arms projecting radially from the spindle limb 28. One of these arms is a first ball-abutment portion or lug 38 and the other of these arms is a second ball-abutment portion or lug 36. The second arm or lug 36 is hairpin-shaped and extends to form a hook portion 40. An elastic rubber band 42 or other resilient member extends between the hook portion 40 and a notch 44 formed in the upper end of the projecting portion 34 of the sleeve 20**.

The pawl mechanism 16 can pivot on its spindle 28 between a first position, shown in full lines in FIG. 1, in which the first ball-abutment portion or lug 38 projects into the interior of the tube 10 through an aperture 46 in its wall and the second abutment portion or lug 36 is withdrawn at least substantially and effectively from the tube interior, and a second position, shown in broken lines in FIG. 1, in which the second lug 36 projects into the interior of the tube 10 through the aperture 46 and the first lug 38 is withdrawn. The elastic band 42 biases the pawl mechanism 16 towards the first of these two positions.

The upper end of the tube 10 is fitted with a collar 48 of resilient material. The collar 48 has an inwardly-directed resilient lip 50 which retains the balls 14 in the tube 10 when the latter is inverted relative to the position shown in FIG. 1. The tube 10, detached from the stand 12 if desired can thus be used as a ball retriever, by having its top end with the collar 48 and lip 50 pressed over balls lying on the ground; the lip prevents the balls from rolling out of the tube 10. It is preferable for the tube to be made of a slightly flexible and compressible material, such as a plastics material, so that the balls 14 can be kept in it easily, when it is being fitted into the stand 12, by slightly squeezing the tube 10.

A chute 52 positioned beneath the lower end of the tube 10 is desirably detachably secured to the lower part of the stand 12. It is useful for the chute 52 to be adjustable so as to guide the balls 14 in a desired direction after they are released from the tube 10. The chute 52 desirably comprises an open channel having an upward tongue 53 at its outer end against which a dispensed ball comes to rest, as shown at 14'' in FIG. 1.

The dispenser of FIGS. 1 and 2 operates as follows: The tube 10 is first charged with golf balls, such as shown at 14, 14', preferably by pushing the upper end of the tube 10 over balls lying on the ground. The lip 50 of the collar 48 deforms around the balls 14,14' as the tube 10 moves over them. The lip 50 subsequently reforms to its normal shape and serves to retain the balls 14,14' in the tube 10 which is then inverted and fitted to the stand 12, the collar 18, the slot 24 and the cradle portion 26 locating and supporting the tube. The balls 14,14' then fall in the tube 10 so that the lowermost ball 14 is held by the first abutment portion or lug 38 of the pawl mechanism 16. The remainder of the balls 14' etc form a stack on the lowermost ball 14. To release a ball from the dispenser, the operating handle 30 is moved downwards (as indicated by the arrow A in FIG. 1) from its first position to its second position, against the bias of the elastic band 42. This movement removes the first abutment portion or lug 38 from the interior of the tube 10 and simultaneously causes the second abutment portion or lug 36 to project into the tube interior. This allows all the balls to move down the tube 10 until the leading ball 14 is released by the lug 38, but is then held by the lug 36.

Figures 3, 3A:
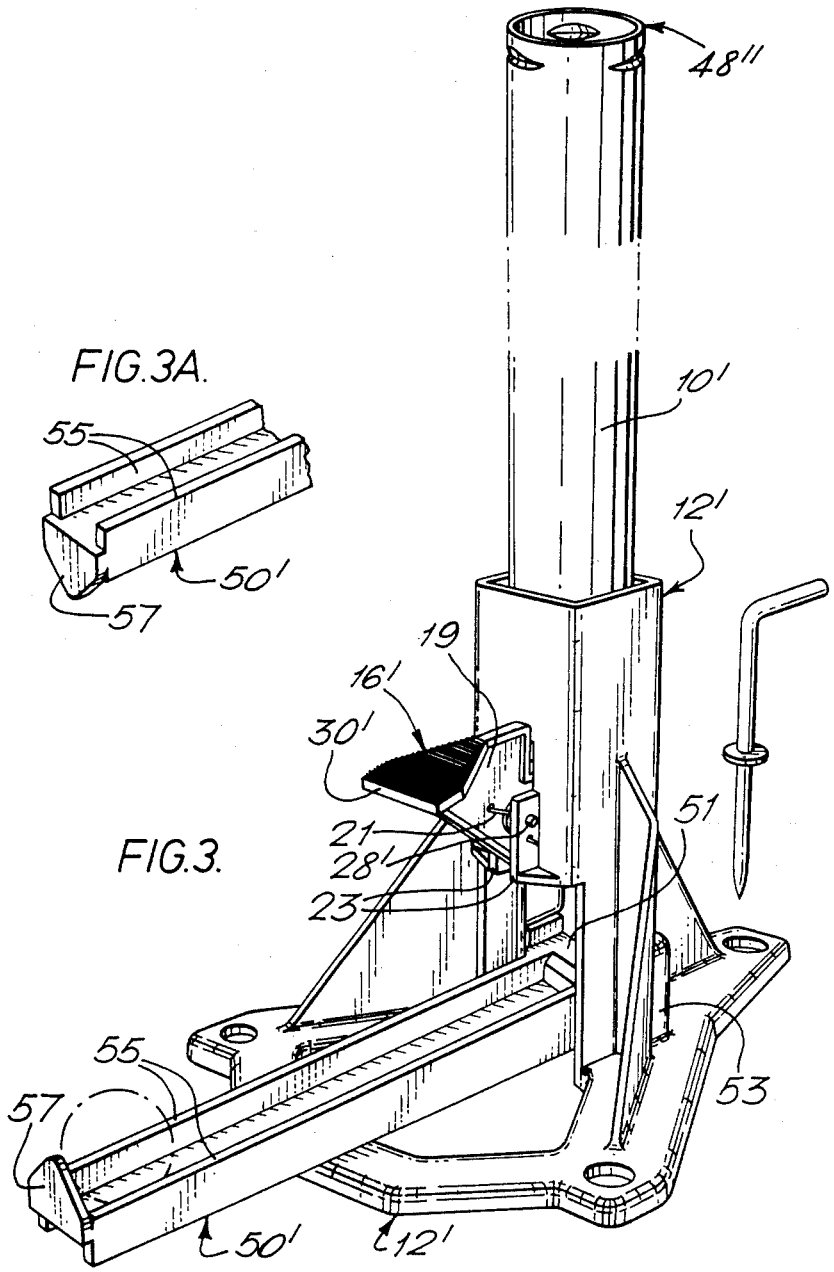
FIG. 3 shows a perspective view of another form of golf ball dispenser, operating on a similar basis to the apparatus of FIGS. 1 and 2.
FIG. 3A shows a variant detail.
Figure 4:
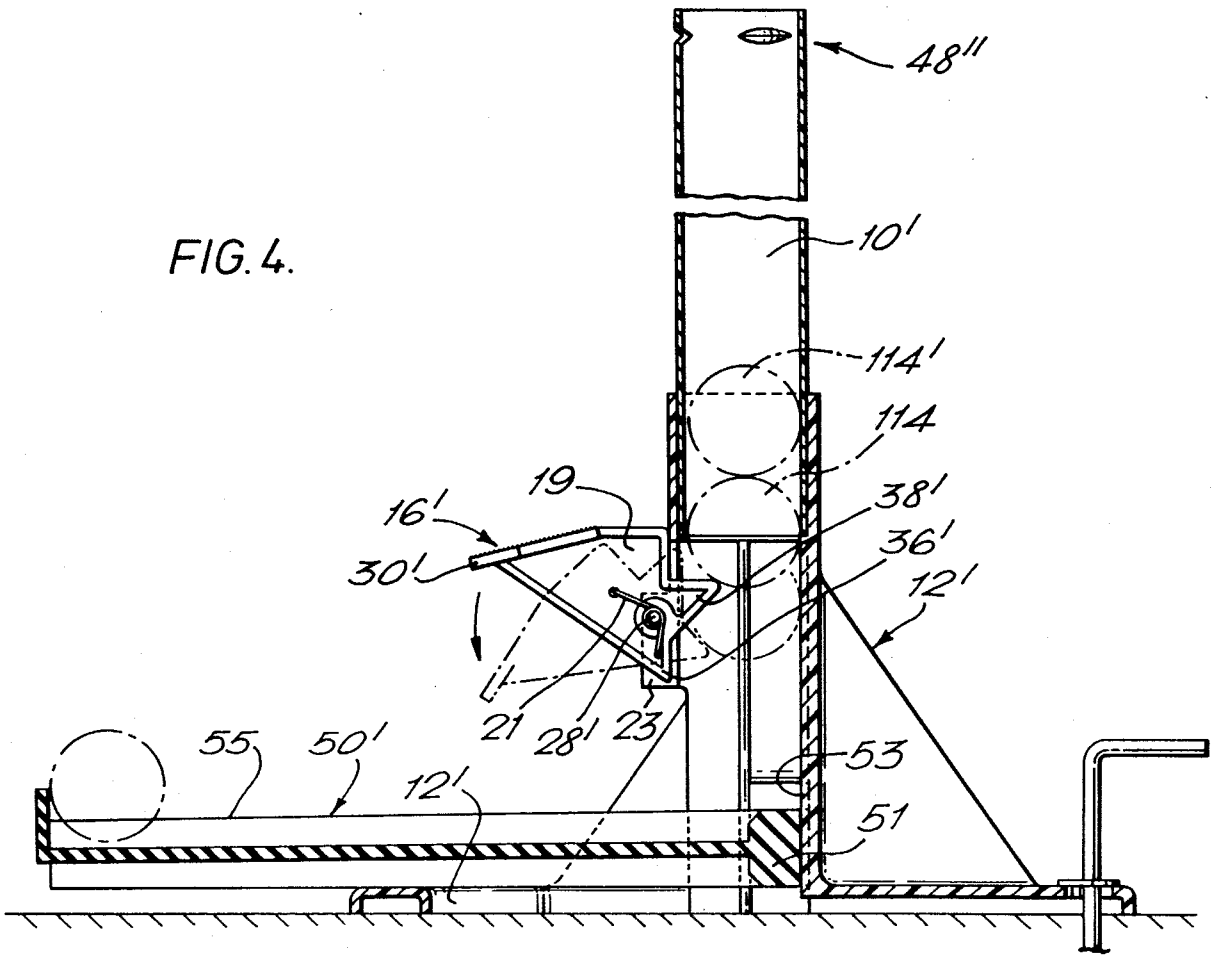
FIG. 4 shows a vertical sectional view of the dispenser of FIG. 3, with a modified form of the top end of the ball storage tube or magazine.

The operating handle 30 is now released and returns to its former position under the biasing influence of the elastic band 42. This movement results in the second abutment portion or lug 36 being withdrawn from the tube interior and the leading ball 14 being released so as to fall from the tube 10 into the chute 50. At the same time, the first abutment portion or lug 38 returns to its blocking position and restrains the now-leading ball 14' from movement. Upon a further depression of the handle 30, the ball 14' is released by the first portion or lug 38 and is held by the second portion or lug 36 and return of the handle 30 to its first position allows the ball 14' to be freed by the lug 36 and dispensed from the tube 10. Another version of the ball dispenser of the invention is shown in FIGS. 3 and 4 and can have a vertically extending tube 10' similar in principle to the tube 10. The resilient collar 48 with the lip 50 of the tube 10 of the first form of dispenser can be replaced in any embodiment of the apparatus of the invention by at least one (for example three or four) inwardly-directed protrusions in the tube wall, as shown at 48' in FIG. 3 and at 48'' in yet another variation in FIG. 4. The protrusions 48' or 48'' deform outwardly to allow balls to enter the tube 10' and are subsequently restored to their original shape so as to retain the balls in the tube 10'.

In the embodiment shown in FIGS. 3 and 4, the ball-releasing pawl mechanism is shown at 16' and is pivotally attached to a stand 12' below the open lower end of the tube 10' containing the balls 114,114' (FIG. 4).

The pawl mechanism 16' in this embodiment consists of a pivotable lever or pedal and is formed as a one-piece plastics moulding, which is mounted on a pin 28' secured in opposed flanges 23 in the stand 12', described below, so as to provide for pivotal movement of the mechanism 16'. This lever or pedal 16' comprises a central web 19 supporting a generally horizontal pad 30' and the web 19 is shaped to include a first ball abutting tongue portion 38' and a second ball-abutting tongue portion 36'. The lever or pedal 16' is biased into the position shown in full lines in FIG. 4 by means of a spring 21 surrounding the pivot pin 28' between the web 19 and one of the flanges 23.

The lever or pedal forming the pawl mechanism 16' can pivot on its spindle 28' between a first position, in which the first tongue portion 38' projects into the tube 10' and the second tongue portion 36' is clear of the tube 10', and a second position, in which the positions of the tongue portions 36' and 38' with respect to the tube 10' are reversed.

When using this form of dispenser, the tube 10' is charged with golf balls and is inverted and fitted to the stand 12', as in the case of the first form of dispenser described above. The balls 114,114' fall down the tube 10' until the lowermost ball 114 is restrained by the first tongue portion 38' of the pawl mechanism 16'. The remainder of the balls 114' etc form a stack on the lowermost ball 114. To dispense this ball 114 from the stack, the operating lever or pad 30' is moved downwardly, against the bias of the spring 21. This movement withdraws the first tongue portion 38' from below the end of the tube 10' and, simultaneously, the second tongue portion 36' moves radially inwardly of the tube but therebelow. This results in the balls 114,114' moving down the tube 10' until the lowermost ball 114 is restrained by the second tongue portion 36', as shown in dashed lines in FIG. 4.

The operating handle 30' is now released and returns to its former position under the spring bias. This return movement results in the second tongue portion 36' being withdrawn from directly below the lower end of the tube 10' and the leading ball 114 being dispensed into the chute 50'. At the same time, the second abutment portion 38' returns to its blocking position and restrians the now-leading ball 114' from downward movement.

The chute 50' is preferably a one-piece construction of heavy but flexible rubber composition and is fitted by means of integral lugs 51 which lock into corresponding recesses 53 formed in the lower part of the stand 12'. The chute 50' comprises a pair of parallel ridges 55 along which the balls will roll. The density of the rubber composition ensures that the free outer end of the chute is tilted slightly downwards. The end includes an inverted V-shaped stop member 57 against which the dispensed balls come to rest and from which they can be propelled, either by right-handed or left-handed golfers, using any desired club, but especially drivers and other clubs which are often used to propel teed-up balls. If the chute 50' is reversed, as shown in FIG. 3A, the absence of a stop end such as 57 allows the balls to travel across the ground, where the apparatus is set up, until they come to rest, so that the ball dispenser is then suitable for golf practice with clubs such as putters which are normally used with balls on the ground.

Figure 5:
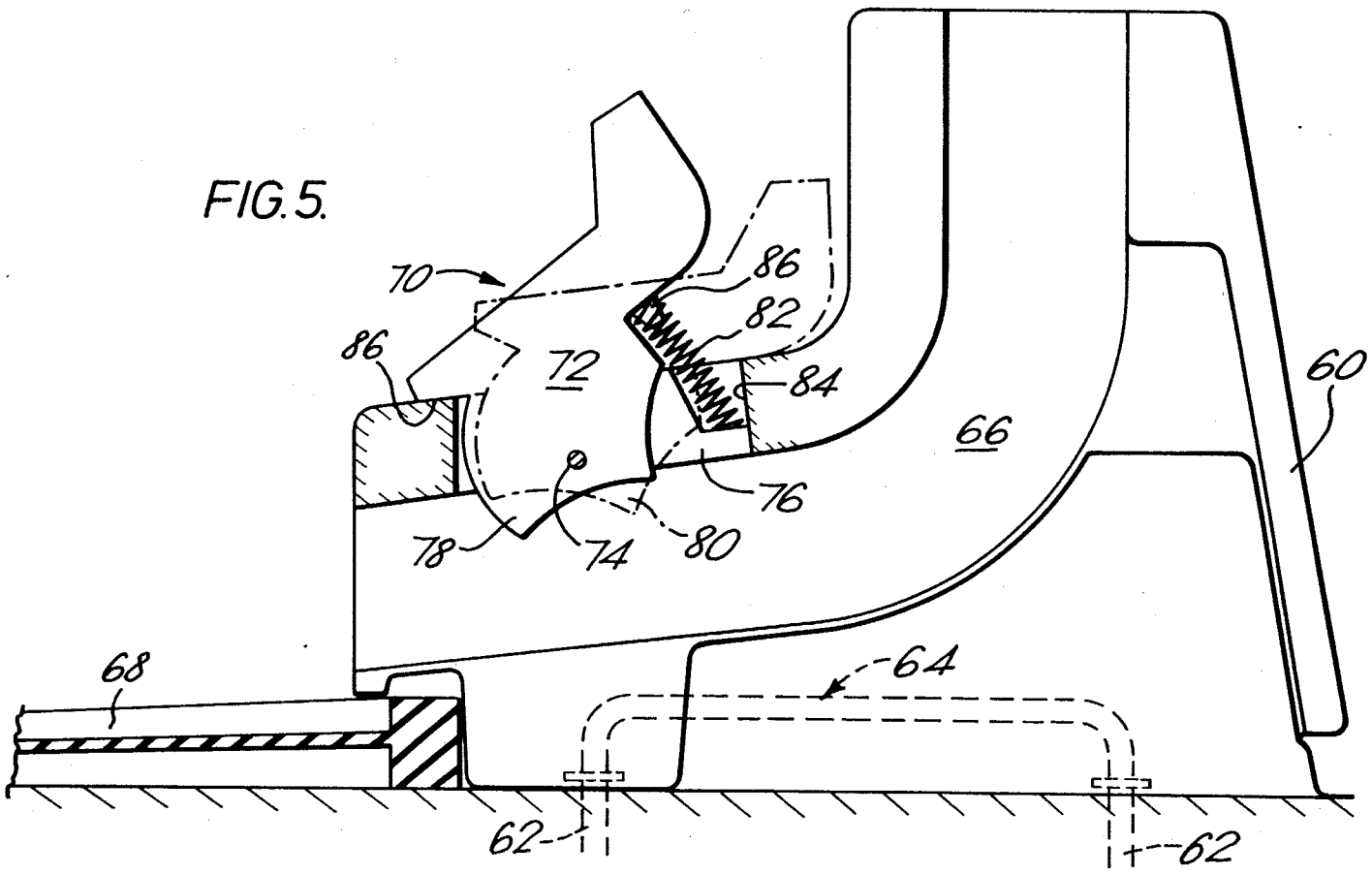
FIG. 5 shows a vertical sectional view of the lower part of yet a further form of golf ball dispenser.

FIG. 5 shows a lower portion of a further form of ball dispenser embodying the invention. The dispenser has a base 60 which like those in the other embodiments can be fixed on the ground by inserting two spiked limbs 62 of a U-shaped piece of metal rod 64, for instance. The base 60 has a passage 66 extending through it, which bends through about 80° from the vertical. The base 60 has means (not shown) to receive, in registration with the upper end of the passage 66, a tube similar to the tube 10 of the first dispenser. A chute 68 is positioned beneath the lower end of the passage 66.

A ball-releasing pawl mechanism 70 includes a plate 72 which is pivotally mounted on an axle 74 and extends through an aperture 76 in a wall of the passage 66. The plate 72 has first and second ball-abutment pawl portions 78, 80 arranged to block the movement of balls in the passage 66. The plate 72 is biassed by a compression spring 82, seated in a recess 84 on the base 60 and over a lug 86 on the plate 72, into a position shown in full lines in FIG. 3 in which the first pawl portion 78 projects into the passage 66. In this position, a stop 86 on the plate 72 abuts the base 60 adjacent the aperture 76. When the plate 72 is rotated against the bias of the spring 82 into the position shown in dashed lines in FIG. 5, the second pawl portion 80 blocks the movement of balls in the passage 66.

For use, the tube of the dispenser of FIG. 5 is charged with balls in the way described above and then fitted to the base 60. The balls fall from the tube 10 and roll down the passage 66 until movement of the leading ball is blocked by the first pawl portion 78 of the plate 72. When it is desired to dispense a ball, the plate 72 is rotated clockwise against the bias of the spring 82. The pawl portion 78 is thus withdrawn from the passage 66 and the leading ball is released onto the chute 68. Simultaneously, the second pawl portion 80 moves to project into the passage 66 and abut the penultimate ball in the passage to prevent its release.

Upon release of the plate 72, the second pawl portion 80 is retracted from the passage 66 and pawl portion 78 moves to project into the passage. The now-leading ball in the passage, and the balls upstream of it, roll down the passage until the leading ball abuts the first pawl portion 78 of the plate 72. Thus, a single depression and release of the plate 72 dispenses the leading ball from the stream of balls in the passage 66. The dispenser is now ready to dispense a further ball.

I claim:

1. In an apparatus for dispensing balls which comprises a magazine (10) for receiving a plurality of balls (14, 14') and mounted on a base portion so as to extend downwardly to permit the balls (14) to be dispensed from the lower end thereof, and ball-releasing means (16) having a first condition in which the lowermost ball (14) is restrained in the magazine (10) and a second condition in which the lowermost ball (14) is released from the magazine (10) and another ball (14') is restrained in the magazine (10), the ball-releasing means (16) being operable by change between the two conditions to dispense at least the lowermost ball (14) whilst restraining at least one other ball (14') in the apparatus, said base portion including a chute (52, 50', 68) for directing balls dispensed from said magazine to a desired position; the improvement in which the chute (52, 50', 68) is detachably mountable upon said base portion in either of two positions that are inverted relative to each other, the chute including a stop member (57) at the outlet end of the chute (52, 50', 68) when in one position of said two positions, whereby use of the chute (52, 50', 68) with the stop member (57) uppermost holds each dispensed ball (14) against the stop member (57), whereas when said chute is in the other position of said two positions said stop member (57) is lowermost and allows each dispensed ball (14) to roll out of said outlet end and come to rest on the ground.

2. An apparatus according to claim 1, wherein the ball-releasing means (16) are movable relative to the magazine (10) between a first position in which the lowermost ball (14) is prevented from movement out of the magazine (10), and a second position, in which such lowermost ball (14) is released and another ball (14') is held.

3. An apparatus according to claim 2, wherein the ball-releasing means (16) comprise a pawl mechanism (16,16',70) mounted for pivotal movement relative to a tube (10,10') forming a guideway of the magazine (10) and has first (38,38',78) and second (36,36',80) portions for respective restraining contact with the lowermost (14) and other (14') balls.

4. An apparatus according to claim 3, wherein the pawl mechanism (16,16',70) is movable by means of a foot or hand-operable lever (30,30',70).

5. An apparatus according to claim 3, wherein a resilient member (42,82) is arranged so as to bias the ball-releasing means (16) towards one of its positions.

6. An apparatus according to claim 5, wherein movement of the pawl mechanism (16,16') against the bias of the resilient member (42) from its first position to its second position releases the lowermost ball (14) from being held by the first portion (38,38') and such ball (14) moves until held by the second portion (36,36') and return of the pawl mechanism (16,16') under the bias of the resilient member (42), releases the first ball (14) from the apparatus and holds the other ball (14') with the pawl mechanism (16,16') returned to its first position, whereby movement of the pawl mechanism (16,16') from its first position to the second prepares the first ball (14) for release from the apparatus and movement of the pawl mechanism (16,16') from its second position to the first dispenses the first ball (14) from the apparatus and prepares another ball (14') for the next operation of the apparatus.

7. An apparatus according to claim 3, wherein the tube (10,10') is removably mounted upon a stand (12,12',60) forming a base portion of the apparatus including the ball-releasing means (16,16',70).

8. An apparatus according to claim 7, wherein the tube (10,10') is engageable with the base portion, at one of its ends and, at the other end, has at least one deformable member (48,48',48'') directed inwardly thereof and deformable outwardly thereof to permit balls to be retrieved from a support, such as the ground, and stored in the tube (10,10').

* * * * *